United States Patent [19]

Van Meter

[11] 4,036,466

[45] July 19, 1977

[54] FLYING DECK-TYPE CONCRETE FORM INSTALLATION

[75] Inventor: Richard A. Van Meter, Rolling Meadows, Ill.

[73] Assignee: Symons Corporation, Des Plaines, Ill.

[21] Appl. No.: 568,607

[22] Filed: Apr. 16, 1975

Related U.S. Application Data

[63] Continuation-in-part of Ser. No. 426,965, Dec. 20, 1973, abandoned.

[51] Int. Cl.[2] ..... E04G 11/38; E04G 11/56

[52] U.S. Cl. ..... 249/18; 182/184; 249/210

[58] Field of Search ..... 52/637–638; 182/182–184; 249/18, 26–32, 210, 219 R

[56] References Cited

U.S. PATENT DOCUMENTS

| | | | |
|---|---|---|---|
| 1,211,812 | 1/1917 | Barnes | 249/210 |
| 1,498,665 | 6/1924 | MacIvor | 249/18 |
| 1,707,226 | 4/1929 | Kepple | 249/29 |
| 2,631,900 | 3/1953 | Simpson | 52/637 |
| 3,190,405 | 6/1965 | Squire | 52/637 |
| 3,420,030 | 1/1969 | Kosmach et al. | 248/354 |
| 3,485,005 | 12/1969 | Kutchai | 52/638 |
| 3,520,508 | 7/1970 | Sewell et al. | 249/18 |

FOREIGN PATENT DOCUMENTS

| | | | |
|---|---|---|---|
| 36,433 | 7/1911 | Denmark | 249/27 |
| 59,696 | 6/1954 | France | 182/183 |
| 1,807,257 | 2/1970 | Germany | 249/28 |
| 1,130,703 | 10/1968 | United Kingdom | 182/184 |

OTHER PUBLICATIONS

Safway Steel Products Bulletin; Form No. 2–117; 8/30/1968.

*Primary Examiner*—Francis S. Husar
*Assistant Examiner*—John McQuade
*Attorney, Agent, or Firm*—Norman H. Gerlach

[57] ABSTRACT

A unitary concrete form installation of the flying deck type, preadjustable to selected dimensions and adapted to produce a horizontal building floor slab, comprises a deck formwork including a pair of deck supporting stringers, and scaffolding supporting the stringers and consequently the formwork, the scaffolding including spaced supporting posts disposed in quadrilateral relationship beneath the stringers, each post including elevator screw means for varying the effective length of the post, a shore head mounted on the upper end of each post and releasably secured to a stringer, pairs of cross braces of selected length extending between longitudinally and transversely spaced pairs of posts, and means for releasably securing the cross braces to the posts, thereby providing a form installation which may be transported as a single unit from one location to another for producing floor slabs in successive locations without dismantling the installation between locations and which may be dismantled following use.

2 Claims, 7 Drawing Figures

FLYING DECK-TYPE CONCRETE FORM INSTALLATION

RELATED APPLICATION

This is a continuation-in-part of application Ser. No. 426,965, filed Dec. 20, 1973, now abandoned.

BACKGROUND OF THE INVENTION

This invention relates to unitary concrete form installations or assemblies of the flying deck type.

Flying deck forms are a combination of vertical shores and deck forms designed specifically for use in the construction of multi-story structures having typical slabs. Each concrete form installation or assembly consists of an independent block of scaffolding which supports a prefabricated form. Individual installations are placed side-by-side and end-to-end, to form a continuous deck form, which serves as a base for a concrete pour. The installations are flown from floor to floor by means of a crane.

Heretofore, in connection with the erection of internal scaffolding for supporting the deck formwork in flying deck forms, it has been the practice to arrange a series of longitudinally extending sills directly beneath the longitudinal stringers which invariably are a part of the deck formwork, and to cause such stringers to be supported from the sills by means of vertical shoring posts, the lower ends of which rest upon the sills and the upper ends of which carry the stringers. The various posts are aligned both longitudinally and transversely, and they are connected together by braces. It has been standard practice to prefabricate such scaffolding in the form of unit frames, each frame consisting of two posts, together with braces which fixedly and permanently connect the posts together. The frames have been used in either one of two ways; in one way, the frames span adjacent sills, and adjacent frames are connected together by cross braces extending between adjacent posts on each sill. In the other way, the frames extend and are spaced apart along individual sills, and the frames are connected together by cross braces extending between posts on adjacent sills, the cross braces thus spanning the sills. In either manner of use, the fixed frame width represents a design limitation: where the frame width is not sized to support the load at the optimum number or spacing of support points, which frequently is the case, it is necessary for adequate support in certain instances that extra or addtional frames be used and, at times, that extra stringers and sills be used. As a result, the installation ultimately exceeds the requirements for supporting the load in many cases, at increased cost and weight, and possibly increased difficulty in handling. It is impractical, as an alternative, to stock fixed frames in the variety of widths which may be suitable.

SUMMARY OF THE INVENTION

The present invention provides a unitary concrete form installation of the flying deck type, preadjustable to selected dimensions and adapted to produce a horizontal building floor slab, which comprises, a deck formwork including a pair of horizontally disposed front and rear longitudinally extending deck-supporting stringers spaced apart a selected distance, and scaffolding operatively supporting the stringers and consequently the formwork, the scaffolding comprising a pair of longitudinally spaced supporting posts vertically disposed beneath each of the stringers, the posts being disposed in quadrilateral relationship whereby each post beneath the front stringer is tranversely aligned with a corresponding post beneath the rear stringer, each of the posts including elevator screw means comprising a screw telescopically movable with respect to the remainder of the post for varying the effective length of the post, a shore head mounted on the upper end of each post, means for releasably securing each shore head to a superjacent stringer in supporting relationship, a pair of cross braces of selected length extending longitudinally between each pair of longitudinally spaced posts, a pair of cross braces of selected length extending transversely between each pair of transversely aligned posts, and means for releasably securing the cross braces to the posts between which they extend, thereby providing a form installation which may be transported as a single unit from one location to another for producing floor slabs in successive locations without dismantling the installation between locations and which may be dismantled following use.

Employing the concrete form installation of the invention, it is now possible to design the installation precisely for obtaining optimum support of the load, both in terms of safety and reliability, and in terms of a minimal number of scaffolding parts and stringers, with minimal cost and weight thereof. The ability to employ an optimum design further minimizes the crane capacity required for a job and/or increases the size of the installation that can be handled and flown, while at the same time, owing to the minimization of structure, making the installation easier to handle.

The elevator screw means provides for vertical adjustment of the deck of the formwork, and also for lowering or dropping the formwork away from the concrete after setting. Where flat slabs are being poured, the installation may be supported on suitable rolling devices for movement to the edge of the building, from whence the installation subsequently is removed and transferred to a higher floor by a crane. In a preferred embodiment of the invention, the posts are constructed so as to enable the installation to be removed where it is necessary to clear a downturned or an upturned spandrel beam, curb, crown or other obstruction on the slab. Thus, the preferred embodiment includes posts which further comprise a sleeve, a staff telescopically movable in the sleeve, and means for securing the sleeve and staff together in any one of a plurality of positions of longitudinal adjustment for further varying the effective length of the post. Employing this structure, the installation may be moved with the aid of a jacking device, which serves to support, lower and/or raise the installation while the sleeve and the staff are adjusted relative to each other prior to and subsequent to each successive concrete pour.

In order to impart strength and rigidity to the installation, it is preferred that at least one horizontally disposed brace of selected length extend between each pair of posts, both longitudinally and transversely. As with the cross braces, means are provided for releasably securing the horizontally disposed braces to the posts. The horizontally disposed braces may be of similar nature to the cross braces, and, alternatively, sills may constitute some of the horizontal braces.

The means for releasably securing the braces, other than the sills, to the posts preferably comprise studs extending radially from the posts, more particularly, from the sleeves thereof. It is further preferred to provide two vertically spaced apart pairs of studs extending from each post, the studs in each pair extending at a right angle to each other and in vertically spaced apart relation. With this structure, a basic "tower" or module may be extended in any direction, while the braces extend between successive posts without interference with each other.

The objects of the invention include the provision of a concrete form installation having the structural features and advantages described above. Other structural features and advantages, accomplishing additional objects, will become apparent from the description of preferred embodiments of the invention hereinafter.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENTS

Figure 1:
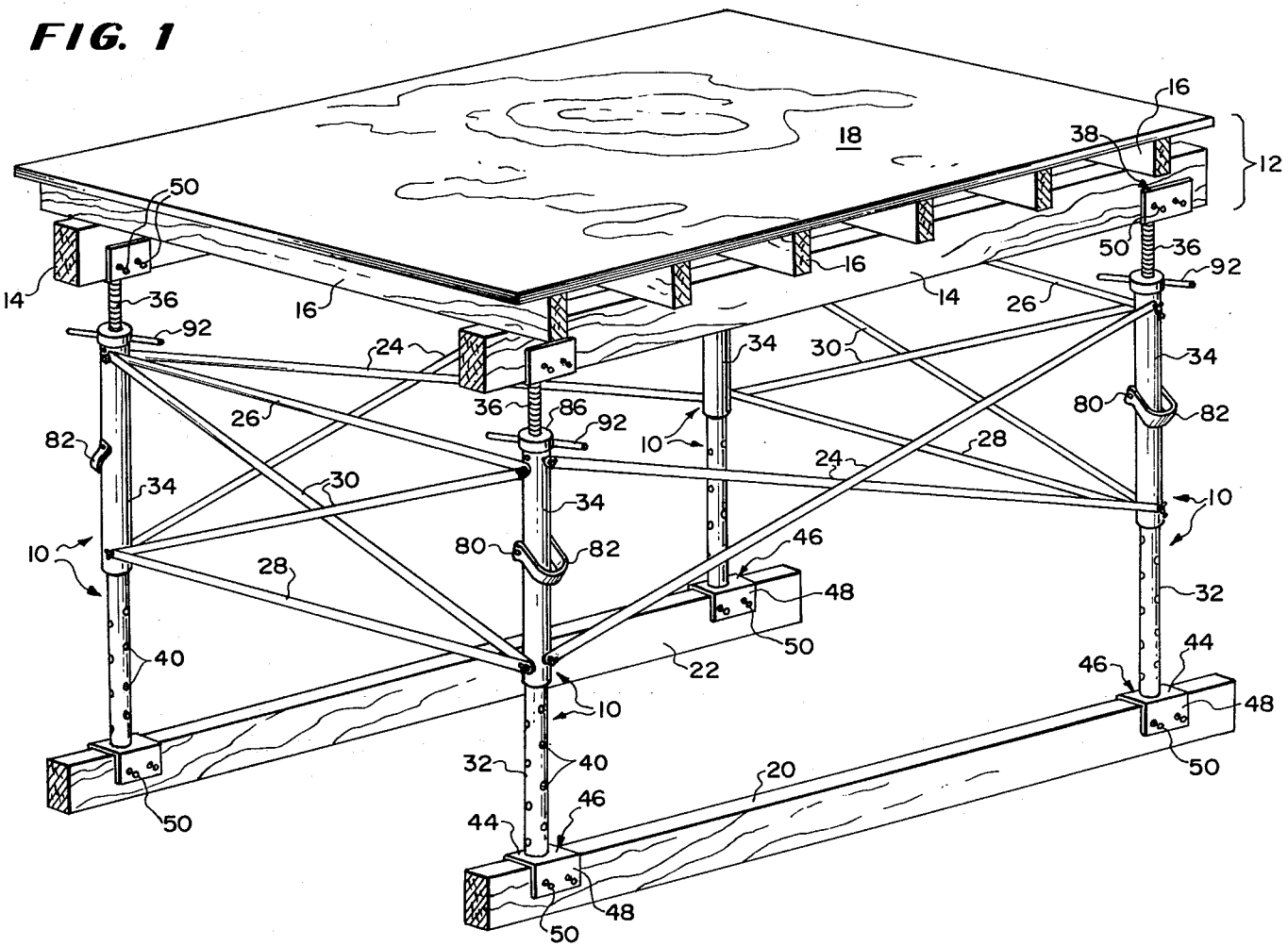
FIG. 1 is a perspective view of a concrete form installation or assembly embodying the principles of the present invention, showing the scaffolding in associated supporting relationship with respect to a concrete slab-forming formwork.

Referring now to the drawings, and in particular to FIG. 1, there is disclosed in this view a typical flying deck type concrete form installation constructed in accordance with the invention. The installation includes scaffolding embodying four vertically extending, laterally spaced posts 10 which are arranged in quadrilateral relationship and serve to support at their upper ends a concrete slab-forming formwork 12. The formwork 12 may be of various types, but in the illustrated form of the invention as shown in FIG. 1, it embodies a pair of spaced apart, longitudinally extending wooden stringers 14 and a plurality of transversely extending joists 16. It also embodies a horizontal deck-forming panel unit 18 preferably formed of plywood, on which wet concrete is poured incident to the formation of a concrete floor slab. The illustration of FIG. 1 shows a unitary "tower" consisting of one panel unit 18 and an associated unit of the scaffolding which supports it, it being understood that other panel units 18 may be positioned in edge-to-edge fashion alongside the illustrated panel unit 18 so as to define a continuous unbroken slab-supporting surface on which the wet concrete of the slab is adapted to be poured. Similarly, and as will be described in greater detail subsequently, the illustrated or system of scaffolding may be regarded as a scaffold unit which may be added to by the inclusion of additional posts such as the posts 10 to lend support to the additional panel units 18 wherever they may be positioned. Such structure may be combined in one unitary flying deck form.

As previously stated, the four posts 10 are disposed in quadrilateral relationship and two of them, which may be regarded as front posts, are supported on a front wooden sill 20, the two other posts being supported on a rear wooden sill 22. The sills 20 and 22 are spaced apart and extend in the longitudinal direction of the scaffolding. The two sills 20 and 22 are connected to the posts 10, as described hereinafter, and thus also function as horizontal braces. The front posts 10 also are connected together by means of a pair of cross braces 24, while the adjacent transversely disposed posts are connected together by a pair of upper and lower horizontal braces or tie bars 26 and 28 and also by a pair of cross braces 30.

The four posts 10 are identical in construction and, therefore, a description of one of them will suffice for them all. As best shown in FIGS. 2, 3, 5, 6 and 7 of the drawings, each post 10 embodies three telescopic parts including an inner lower staff 32, an outer intermediate sleeve 34, and an inner upper elevation screw 36. A shore head 38 is carried at the upper end of the elevation screw 36. The inner lower staff 32 is of open-ended tubular construction, and the wall thereof is provided with a multiplicity of adjustment holes 40 therein. The holes 40 are arranged in four vertical rows, the holes of each pair of adjacent rows being staggered from one another for purposes that will be made clear presently.

The open lower end of the tubular staff 32 is telescopically received over an upstanding pilot post 42 (see FIG. 5) which is formed centrally on the upper web portion 44 of an inverted U-shaped saddle member or base 46. The depending side flanges 48 of the saddle member 46 straddle the associated sill 20 or 22, as the case may be, on which the post 10 is supported. The saddle member 46 is fixedly and releasably secured in position on its associated sill by means of mechanical fasteners such as dual-headed nails 50 (see FIG. 1) which are driven into the sill through nail holes 52 or the like in the side flanges 48. The use of dual-headed nails facilitates knockdown procedure when the scaffolding is to be dismantled. The lower end of the staff 32 is provided with a pair of oppositely disposed aligned mounting holes 54 (see FIG. 5) which register with a transverse bore 56 in the pilot post 42. A bolt 58 has its shank portion projecting through the mounting holes 54 and the bore 56, and the bolt is secured in position by means of a nut 60, thus fixedly and securely connecting the saddle member 46 to the staff 32.

The lower end of the outer tubular sleeve 34 of each post 10 which, as previously stated, is telescopically received over the staff 32, is formed with two aligned adjustment holes 62 (see FIG. 6) which are designed for selective register with the various pairs of opposed adjustment holes 40 in the staff 32. A conventional fast pin or quick-release pin 64 is adapted to be projected through the aligned adjustment holes 62 and 40, to maintain the sleeve 34 at any selected elevation with respect to the staff 32. By causing the holes 40 of opposed rows to register with one another and by causing the holes of adjacent rows to be staggered, small increments of height adjustment of the sleeve 34 on the staff 32 may be effected without crowding the holes 40 and thus weakening the metal of the staff.

Figure 2:
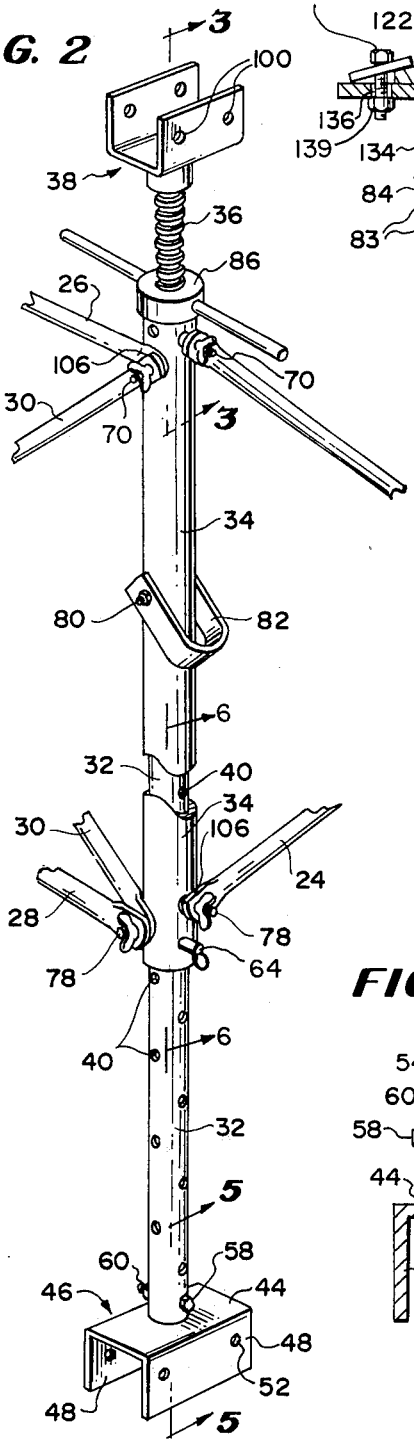
FIG. 2 is an enlarged fragmentary perspective view of one corner region of the scaffolding of FIG. 1.
Figure 3:
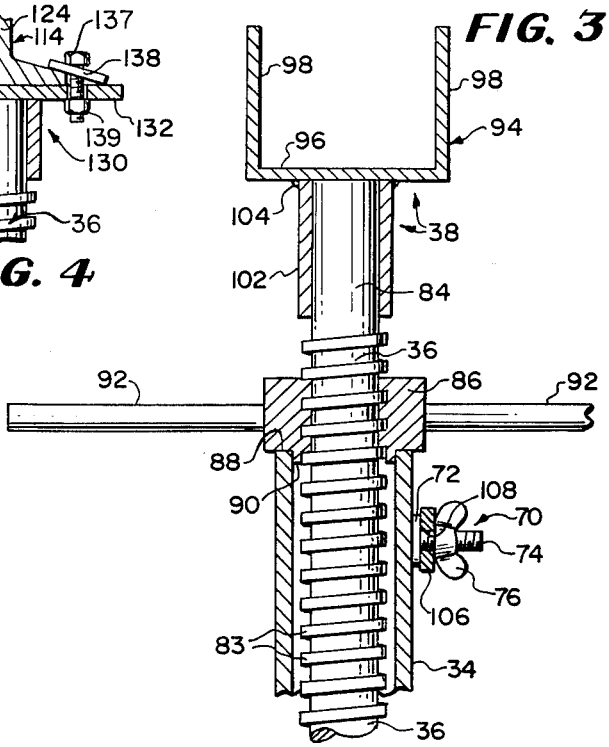
FIG. 3 is a further enlarged fragmentary sectional view taken on the vertical plane indicated by the line 3—3 of FIG. 2 and in the direction of the arrows.
Figure 6:
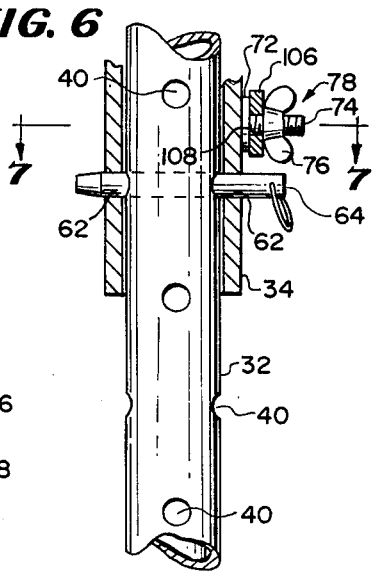
FIG. 6 is an enlarged sectional view taken on the line 6—6 of FIG. 2.
Figure 5:
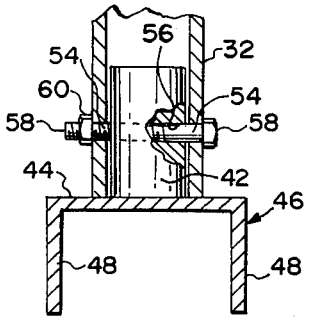
FIG. 5 is an enlarged sectional view taken on the line 5—5 of FIG. 2.
Figure 7:
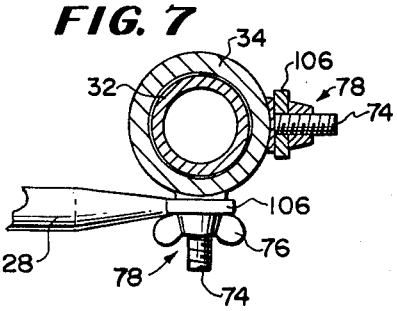
FIG. 7 is a sectional view taken on the line 7—7 of FIG. 6.

As best illustrated in FIGS. 2 and 3 of the drawings, two vertically spaced apart studs 70 are fixedly secured to the upper end region of the outer intermediate sleeve 34 of the post 10 and project radially outwardly therefrom and also at right angles to each other. Each stud is of the shouldered type and includes an inner stud head 72 which is welded to the sleeve 34, and an outer threaded shank 74 is designed for reception of a threaded nut such as a wing nut 76 be means of which one or more braces, such as the horizontal braces 26, 28, or the cross braces 24, 30, may be anchored to the sleeve in a manner that will be set forth subsequently. A similar pair of nut-equipped studs 78 is provided on the sleeve 34 adjacent to the lower end thereof and is designed for a similar purpose.

A through-bolt 80 passes through the post sleeve 34 in the medial region thereof and serves pivotally to secure a lift or hoist shackle 82 in position on the post 10, such shackle being of U-shaped design.

The elevation screw 36 of each post 10 is provided with an external screw thread 83, and the upper end region thereof is formed with an upwardly extending pilot stem 84 on which the aforementioned shore head 38 is supported in a manner that will be made clear presently. As best shown in FIG. 3, a nut 86 is threadedly received on the elevation screw 36 and is supported on the upper open rim 88 of the outer intermediate sleeve 34. A circular pilot flange 90 is formed on the lower side of the nut 86 and projects downwards into the upper end of the sleeve 34 so as to maintain the nut and sleeve in axial alignment at all times. Two coaxial manipulating handles or rods 92 are fixedly connected to and project radially outwardly from the nut 86 and facilitate manual turning of the latter. From the above description, it will be apparent that upon turning of the nut 86 in one direction or the other, the elevation screw 36 will be caused to move axially with respect to the sleeve to increase or decrease the effective length of the post 10.

The shore head 38, which is best illustrated in FIGS. 1, 2, and 3, is designed for use in connection with one of the illustrated wooden stringers 14. Accordingly, it is comprised of a cradle member 94 which is of U-shaped cross section and includes a cradle base 96 and a pair of upwardly extending side flanges 98. As shown in FIG. 1 of the drawings, the cradle 94 receives the associated wooden stringer 14 therein, and nail holes 100 or the like (see FIG. 2) in the flanges 98 enable the shore head 38 as a whole to be fixedly and releasably secured in place on the stringer 14 by means of mechanical fasteners such as the dual-headed nails 50. As shown in FIG. 3, a vertically extending socket-forming tube 102 has its upper end welded as at 104 to the underneath side of the cradle base 96 and receives the pilot stem 84 therein, the upper end of the stem bearing against the base 96 of the cradle member 94.

The various horizontal braces 26, 28 and cross braces 24, 30 are of the appropriate lengths which will accommodate the particular scaffolding installation which is undergoing erection, according to design requirements, these braces being in the form of lengths of tubular metal stock. The opposite ends of each length are flattened as indicated at 106 in FIGS. 2, 3, 6 and 7, and the flattened regions are provided with attachment holes 108 therethrough. The connection between adjacent posts 10 is made by causing the studs 70 and 78 to receive thereover the appropriate flattened ends 106 of the braces, as required, and then applying the wing nuts 76 to the threaded shanks of the studs.

Figure 4:
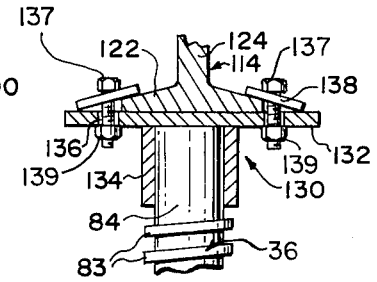
FIG. 4 is a fragmentary sectional view similar to FIG. 3 but showing a modified form of shore head; the latter being designed for use in supporting a steel stringer.

The scaffold post 10 of the present invention are capable of being used in connection with concrete slab form installations which employ steel stringers of the I-beam type, such as has been illustrated fragmentarily in FIG. 4 and designated by the reference numeral 114. A stringer of the tupe under consideration is shown and described in U.S. Pat. No. 3,130,470, granted on Apr. 28, 1964 and entitled "CONCRETE WALL FORM INSTALLATION". The stringer 114 is provided with the usual base 122 from which there extends upwardly a web portion 124 which carries at its upper end the usual top flanges (not shown). In order to accommodate such a stringer, the first-described shore head 38 may be replaced by a similar shore head 130, in which the cradle member 94 is replaced by a flat plate 132 from which there depends a socket-forming tube 134, the latter being designed for reception over the upper end of the elevation screw 36. The plate 132 is provided with holes 136 therethrough, and clamping bolt assemblies 138 are employed for clamping the base 122 of the stringer 114 against the upper surface of the plate 132, the assemblies 138 including bolts 137 which pass through the holes 136 and are secured by nuts 139.

In view of the knockdown character of the concrete form installation, with the several parts and particularly the bracing members being separate, detachable components, the installation is preadjustable to selected dimensions, especially length and width, according to optimum design requirements. Thus, the braces 24, 26, 28 and 30 may be supplied in any desired lengths, and in multiple lengths, and the sills 20, 22 ordinarily are supplied in any desired lengths on the job, to satisfy various design requirements. Also, the posts 10 may be supplied in one or more height ranges, to accommodate different ranges of vertical spacing between floor slabs, and they may be supplied in differing load capacities.

In the erection of the concrete form installation of FIG. 1, four posts 10 having shore heads 38 and saddle members 46 thereon first are secured by the traverse horizontal and cross braces 26, 28 and 30, and the wing nuts 76, and are set in position on the sills 20 and 22 at appropriate locations. The posts 10 on each sill next are secured by the longitudinal cross braces 24 and the wing nuts 76. The saddle members 46 associated with the inner lower staffs 32 then are nailed to the sills 20 and 22. Thereafter, the outer intermediate sleeves 34 of the posts are brought to the desired elevation by sliding the same on the staffs 32, and the sleeves are secured in place by means of the fast pins 64, as previously described. Alternatively, this adjustment may be made prior to erection. The stringers 14 of the formwork 12 then are inserted in the cradles 94 of the shore heads 38 and fixedly secured in place by the dual-headed nails 50, and the joists 16 and the panel unit 18 are secured on the stringers. Deck leveling operations are conducted by proper manipulation of the adjusting nuts 86. A similar sequence of operations is followed when the shore heads 130 and the I-beam stringers 114 of FIG. 4 are used.

The cross braces 24, 30 in the form installation serve to prevent non-rectangular parallelogram formation of the posts 10 in the scaffolding. Connection of the posts 10 to the framework 12 serves to prevent trapezoid formation, whereby a stable, plumb installation may be constructed. Trapezoid formation also may be prevented by joining pairs of cross braces at their midpoints by pivot pins, in conventional manner. The preferred illustrative embodiment of the form installation, having horizontal braces in the form of the sills 20, 22 and the tubular horizontal braces 26, 28, in addition to the cross braces 24, 30, is especially strong, stable, and rigid. The use of the sills 20, 22 and the horizontal braces 26, 28 further insures that the structure is plumb, these elements also serving to prevent trapezoid formation. The preferred installation is especially resistant to stresses and blows, maintaining its integrity during use and in transit between use locations.

While the invention has been described with reference to a basic four-post unit of installation, it is contemplated that this stable unit or "tower" in common practice will serve as but a part of a complete unitary flying form. Thus, for example, it is convenient to employ the illustrative unit at a corner, from which additions can be made in two directions to complete the form. To the basic unit are added sills 20 and 22 (longer sills may be used). posts 10 with shore heads 38 and saddle members 46 thereon, and braces 24, 26, 28 and 30. In this connection, the length of the shank portions 74 of the studs 70 and 78 (see FIGS. 6 and 7) is sufficient to accommodate the flattened ends of at least four braces. The vertical spacing between the studs in each pair of adjacent studs 70 and 78 (see FIG. 2) affords clearance for braces traversing a post 10 in perpendicular directions.

Concrete is poured on the horizontal deck-forming panel unit 18 of the formwork 12 and becomes a self-supporting slab when set. The formwork 12 is lowered bodily in order initially to break the bond between the panel unit 18 and the bottom surface of the formed concrete floor slab, and subsequently to afford clearance whereby the entire form installzation may be removed from the partially formed building and then transferred to the next adjacent higher floor level for reuse in forming another floor slab. For the foregoing purposes, the nuts 86 are turned to lower the elevation screws 36 and the associated shore heads 38 or 130, thereby reducing the effective height of the posts 10 and lowering the supported concrete formwork 12. Thereafter, suitable wheeled hydraulic or other jacks (not shown) may be aplied to the installation to raise the same, until the sills 20, 22 clear the foundation surface At this time, the installation may be moved laterally to the side of the building by suitable means, such as on rollers inserted under the sills 20, 22. The installation is positioned so that it partially projects from the building where hoisting cables may be applied to the shackles 82.

The staffs 32 of the posts 10 come into play where greater adjustment of the vertical length of the posts is required, such as where the floor slabs are cast with upturned or downturned spandrels, curbs, crowns, or other obstructions. In such cases, each staff 32 is moved telescopically into the connected sleeve 34, removing and reinserting the fast pin 64 for that purpose. As an example, in the case of a downturned spandrel, formed on the superjacent slab, the form installation then may be removed in one of the ways described above. As another example, in the case of an upturned spandrel, formed on the subjacent slab, the form installation must be elevated or jacked so that the sills 20, 22 clear the spandrel when the installation may be moved, as by movable jacks or on rollers.

After movement to the side of the building, the form installation may be fully removed from the building and elevated to the next floor level by means of an overhead hoist such as a crane or the like. The installation then may be moved into position for forming the next slab. The installation is transported as a single unit from one location to another or a succession of higher floors in the foregoing manner, for producing floor slabs in successive location without dismantling the installation between loctions. Ultimately, when the pouring of slabs having the same requirements is complete, the form installation may be dismantled and subsequently reassembled, with the same parts or with parts of other dimensions.

While certain preferred embodiments of the invention have been shown and described, it will be apparent to those skilled in the art that various changes and modifications may be made therein within the spirit and scope of the invention. It is intended that such changes and modifications be included within the scope of the appended claim.

I claim:

1. A unitary concrete form installation of the flying deck type, preadjustable to selected lengthwise and transverse dimensions and adapted to produce a horizontal building floor slab, said installation comprising, in combination a deck formwork adapted for forming a concrete slab thereon and including a pair of horizontally disposed front and rear longitudinally extending deck-supporting stringers spaced apart a selected distance, and scaffolding operatively supporting said stringers and consequently the formwork, said scaffolding comprising front and rear longituidnally extending base supporting sills of selected length disposed beneath said stringers respectively a pair of longitudinally spaced vertically disposed supporting posts extending between each of said sills and its associated stringer thereabove, said posts being disposed in quadrilateral relationship whereby each post on the front sill is traversely aligned with a corresponding post on the rear sill, each of said posts being of telescopic construction and including an inner lower tubular staff, an inner upper elevation screw, and an outer intermediate sleeve within which said staff and elevation screw are telescopically slidable, an inverted U-shaped saddle member supported on the upper surface of the sill beneath each post and having side flanges which straddle the sill and have performed nail holes therethrough, nails projecting through said nail holes and into the associated sill and serving fixedly to secure each saddle member in position on the associated sill, a pilot post projecting upwardly from each said saddle member, the lower end of each staff being telescopically received over the associated pilot post, a removable fastening pin projecting transversely through each pilot post and the associated staff and serving to secure the staff in position on the associated saddle member, a shore head on each post and having a socket-forming tube depending therefrom, a pilot stem on the upper end of each elevation screw and projecting into the asociated socket-forming tube, means releasably fastening each shore head to the associated stringer in supporting relationship, each said staff being formed with a series of vertically spaced pairs of diametrically opposed holes arranged in vertical rows on opposite sides of the staff, each said sleeve being provided with a pair of diametrically opposed holes in the lower region thereof and designed for selective register with the pairs of holes in the associated staff, a fastening pin projecting through said holes in each sleeve and through a selected pair of opposed holes in the associated staff, a nut threadedly received on each said elevation screw and slidably supported on the upper end of the associated sleeve for sliding rotation thereon, said nut being effective upon turning thereof in opposite directions to raise and lower the elevation screw to vary the effective length of the corresponding post, a pair of tubular cross braces of selected length extending longitudinally between each pair of said longitudinally spaced posts, a pair of tubular cross braces of selected length extending transversely between each pair of said transversely aligned posts, a pair of horizontally disposed vertically spaced apart tubular braces of selected length extending between each pair of transversely aligned posts and disposed on opposite sides of said cross braces extending between the transversely aligned posts, each of said cross braces and horizontally disposed braces extending continuously from one post to the other of the posts between which it extends, flattened ends on said braces having attachment holes therethrough, two vertically spaced apair pairs of threaded studs extending radially from each of said sleeves respectively adjacent to the upper and lower ends thereof, the studs in each pair extending at a right angle to each other and in vertically spaced apart relation, said studs projecting through said attachment holes, and wing nuts threadedly received on said studs and serving to hold the ends of said braces in position on the sleeves, thereby providing a form installation which may be transported as a single unit from one location to another for producing floor slabs in successive locations without dismantling the installation between locations and which may be dismantled following use.

2. A unitary concrete form installation as set forth in claim 1 and including additionally a U-shaped hoist shackle pivotally connected to each of the outer intermediate sleeves.

* * * * *